US010094346B1

(12) United States Patent
De Vita et al.

(10) Patent No.: US 10,094,346 B1
(45) Date of Patent: Oct. 9, 2018

(54) FUEL PUMP WITH AN IMPROVED MAXIMUM-PRESSURE VALVE FOR A DIRECT-INJECTION SYSTEM

(71) Applicant: MAGNETI MARELLI S.p.A., Corbetta (IT)

(72) Inventors: Daniele De Vita, Castel San Pietro Terme (IT); Tommaso Neri, Rome (IT)

(73) Assignee: MAGNETI MARELLI S.p.A., Corbetta (IT)

( * ) Notice: Subject to any disclaimer, the term of this patent is extended or adjusted under 35 U.S.C. 154(b) by 0 days.

(21) Appl. No.: 15/787,024

(22) Filed: Oct. 18, 2017

(51) Int. Cl.

| | |
|---|---|
| ***F02M 59/02*** | (2006.01) |
| ***F02M 59/46*** | (2006.01) |
| ***F02M 37/04*** | (2006.01) |
| ***F02M 55/00*** | (2006.01) |

(52) U.S. Cl.
CPC ..... *F02M 37/043* (2013.01); *F02M 55/002* (2013.01); *F02M 59/02* (2013.01); *F02M 59/464* (2013.01)

(58) Field of Classification Search
CPC ... F02M 37/045; F02M 55/002; F02M 59/464
USPC ..... 123/502, 506
See application file for complete search history.

(56) References Cited

U.S. PATENT DOCUMENTS 5,950,669 A * 9/1999 Fehlmann ..... F02M 59/462 123/467
6,045,120 A 4/2000 Tarr et al.
6,832,619 B1 * 12/2004 Walsh ..... F02M 59/366 137/14
7,401,593 B2 * 7/2008 Rembold ..... F02M 63/0036 123/446
8,430,081 B2 * 4/2013 Mancini ..... F02M 59/462 123/446
9,181,910 B2 * 11/2015 Thorwirth ..... F02M 59/366
2007/0110603 A1 * 5/2007 Usui ..... F02M 63/005 417/505

(Continued)

FOREIGN PATENT DOCUMENTS

CH 390017 A 3/1965
DE 19900883 A1 9/1999

(Continued)

OTHER PUBLICATIONS

Search Report for Italian Patent Application No. 201600070056 dated Jun. 7, 2017.

*Primary Examiner* — Erick Solis
(74) *Attorney, Agent, or Firm* — Howard & Howard Attorneys PLLC

(57) ABSTRACT

Fuel pump for a direct-injection system and having: a pumping chamber; a piston; an intake channel regulated by an intake valve; a delivery channel regulated by a delivery valve; and a drain channel that originates in the delivery channel and is regulated by a maximum-pressure valve having: a shutter, a valve body provided with a valve seat, a calibrated spring for pushing the shutter against the valve seat, and a plate that is arranged in contact with the shutter on the opposite side of the valve seat; the plate of the maximum-pressure valve has a first annular groove, which is arranged around the shutter; and the valve body of the maximum-pressure valve has a second annular groove, which is arranged around the shutter and at least partially faces the first annular groove of the plate.

15 Claims, 7 Drawing Sheets

(56) References Cited

U.S. PATENT DOCUMENTS

| | | | | |
|---|---|---|---|---|
| 2008/0056914 | A1* | 3/2008 | Usui | F02M 55/04 417/307 |
| 2009/0252621 | A1* | 10/2009 | Siegel | F02M 63/0036 417/307 |

FOREIGN PATENT DOCUMENTS

| | | | |
|---|---|---|---|
| DE | 102008036819 | A1 | 2/2010 |
| EP | 2236809 | A2 | 10/2010 |
| GB | 947040 | A | 1/1964 |

* cited by examiner

4

FUEL PUMP WITH AN IMPROVED MAXIMUM-PRESSURE VALVE FOR A DIRECT-INJECTION SYSTEM

CROSS-REFERENCE TO RELATED APPLICATION

This application is related to Italian Patent Application No. 102016000070056 filed on Jul. 6, 2016, the disclosure of which is incorporated by reference.

TECHNICAL FIELD

The present invention relates to a fuel pump for a direct-injection system.

PRIOR ART

A direct-injection system comprises a plurality of injectors, a common rail feeding the pressurized fuel to the injectors, a high-pressure fuel pump feeding the fuel to the common rail through a high-pressure supply duct and provided with a flow regulating device, and a control unit driving the flow regulating device to keep the fuel pressure inside the common rail equal to a desired value that generally varies over time based on the operating conditions of the engine.

The high-pressure pump described in the patent application EP2236809A2 comprises a main body that defines a cylindrical pumping chamber inside which a piston slides with reciprocating motion. It is provided an intake duct regulated by an intake valve for supplying the low-pressure fuel in the pumping chamber and a delivery duct regulated by a delivery valve for supplying the high-pressure fuel out of the pumping chamber and towards the common rail through the supply duct. Generally, the flow regulating device acts on the intake valve, keeping the intake valve open even during the pumping phase, so that a variable amount of the fuel in the pumping chamber comes back to the intake duct and is not pumped towards the common rail through the supply duct.

There is a drain channel connecting the delivery duct to the pumping chamber and regulated by a one-way maximum-pressure valve that allows a fuel flow only from the delivery duct to the pumping chamber. The maximum-pressure valve allows a fuel venting if the fuel pressure in the common rail exceeds a maximum value set in the design phase (e.g. in case of errors in the check carried out by the control unit or in the event of a failure of an injector). In other words, the maximum-pressure valve is calibrated to open automatically when the pressure difference across its ends is higher than a threshold value set in the design phase and therefore to prevent the fuel pressure in the common rail from exceeding the maximum value set in the design phase.

Normally, the maximum-pressure valve comprises a spherical shutter movable along the drain channel and a valve seat, which is designed to be engaged in fluid-tight manner by the shutter; a calibrated spring pushes the shutter towards a fluid-tight engagement position with the valve seat. The elastic force of the spring is calibrated so that the shutter is separated from the valve seat only when the pressure difference across the maximum-pressure valve is higher than the threshold value set in the design phase. In known fuel pumps, currently available on the market, it has been observed that the response of the maximum-pressure valve is not always fast when the pressure in the common rail is only slightly higher than the maximum value set in the design phase, i.e. sometimes the maximum-pressure valve opens with a certain delay when the pressure in the common rail is only slightly higher than the maximum value set in the design phase; consequently, the pressure in the common rail may exceed the maximum value set in the design phase by an increase generally estimated at a few tens of bars (experimentally it has been observed that the increase over the maximum value set at the design phase can reach up to 100 bar).

Taking into account the possible pressure increase in the common rail beyond the maximum value set in the design phase, all components (pipes, common rail, pressure sensor and especially injectors) must be sized to be able to withstand without damage even a sporadic pressure increase in the common rail beyond the maximum value set in the design phase, even if such oversizing provides no functional advantage. It is therefore evident that the oversizing of the components related to the sporadic and undesired increase of the maximum fuel pressure in the common rail beyond the maximum value set in the design phase represents a relevant increase of costs and weight (the mass of the components must be increased to make them more robust) that does not provide any functional advantage.

DESCRIPTION OF THE INVENTION

The object of the present invention is to provide a fuel pump for a direct-injection system, wherein said fuel pump is free from the aforesaid drawbacks and is at the same time inexpensive and easy to manufacture.

According to the present invention, it is provided a fuel pump for a direct-injection system as claimed in the appended claims.

BRIEF DESCRIPTION OF THE DRAWINGS

The present invention will now be described with reference to the accompanying drawings showing a non-limiting embodiment, wherein.

PREFERRED EMBODIMENTS OF THE INVENTION

Figure 1:
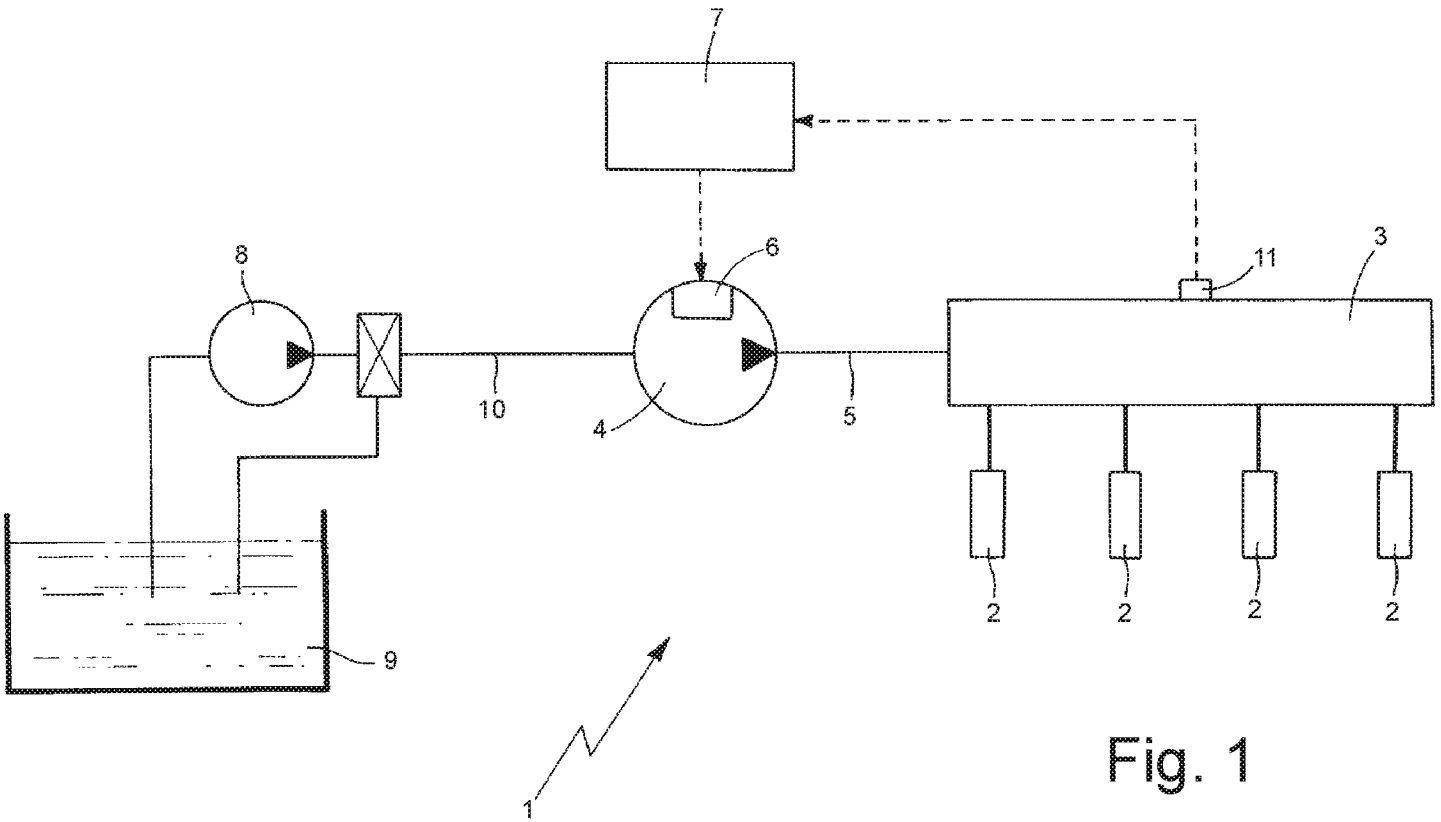
FIG. 1 is a schematic view, lacking some details for clarity's sake, of a common rail, fuel direct-injection system.

In FIG. 1, number 1 indicates as a whole a common rail, fuel direct-injection system for an internal combustion thermal engine. The direct-injection system 1 comprises a plurality of injectors 2, a common rail 3 feeding the pressurized fuel to the injectors 2, a high-pressure pump 4 feeding the fuel to the common rail 3 through a supply duct 5 and provided with a flow adjusting device 6, a control unit 7 keeping the fuel pressure in the common rail 3 equal to a desired value that generally varies over time based on the operating conditions of the engine and a low-pressure pump 8 feeding the fuel from a tank 9 to the high-pressure pump 4 through a supply duct 10.

The control unit 7 is coupled to the flow adjusting device 6 to control the flow rate of the high-pressure pump 4 so as to feed instant by instant to the common rail 3 the required amount of fuel to have the desired pressure value in the common rail 3; in particular, the control unit 7 regulates the flow rate of the high-pressure pump 4 by means of a feedback control using as a feedback variable the fuel pressure value inside the common rail 3, which is the pressure value recorded in real time by a pressure sensor 11.

Figure 2:
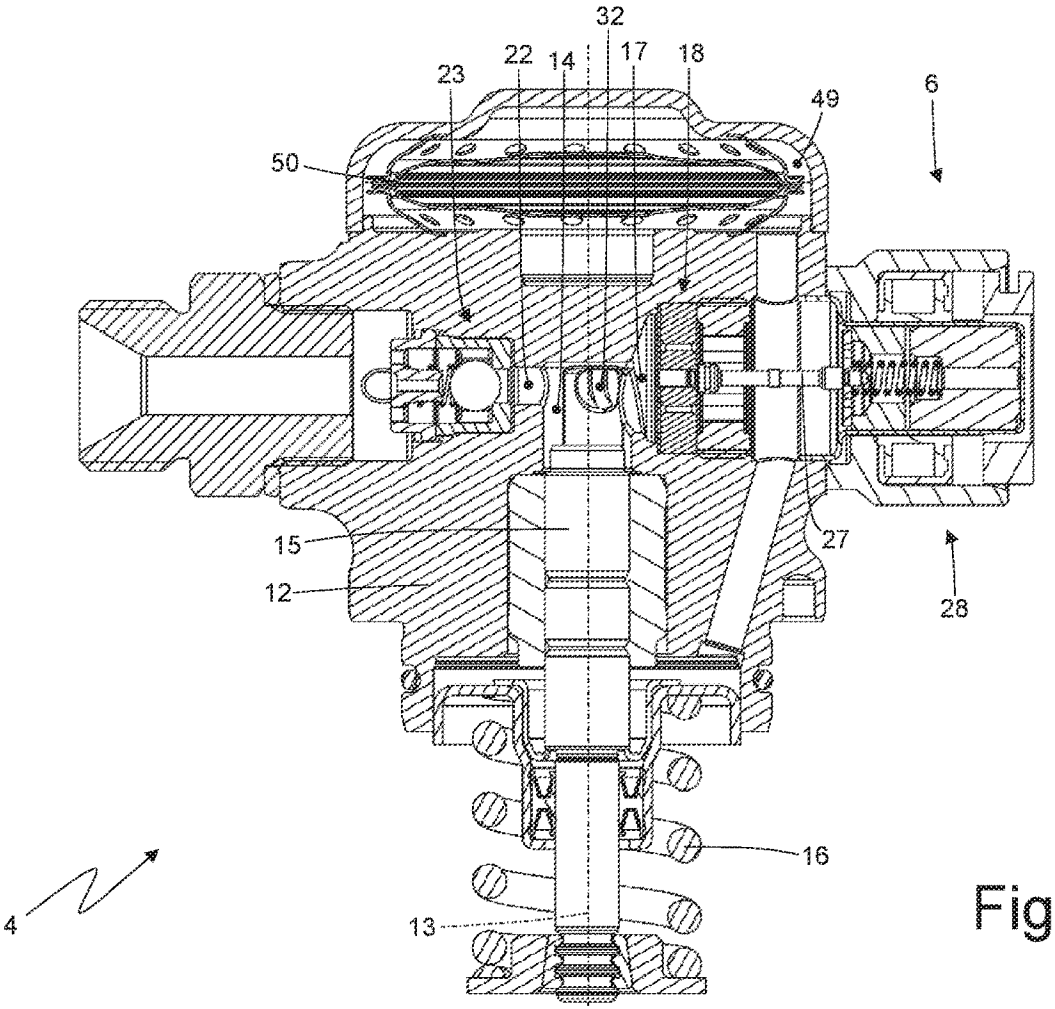
FIG. 2 is a longitudinal section view, lacking some components for clarity's sake, of a high-pressure fuel pump of the direct-injection system of FIG. 1 according to the present invention.
Figure 3:
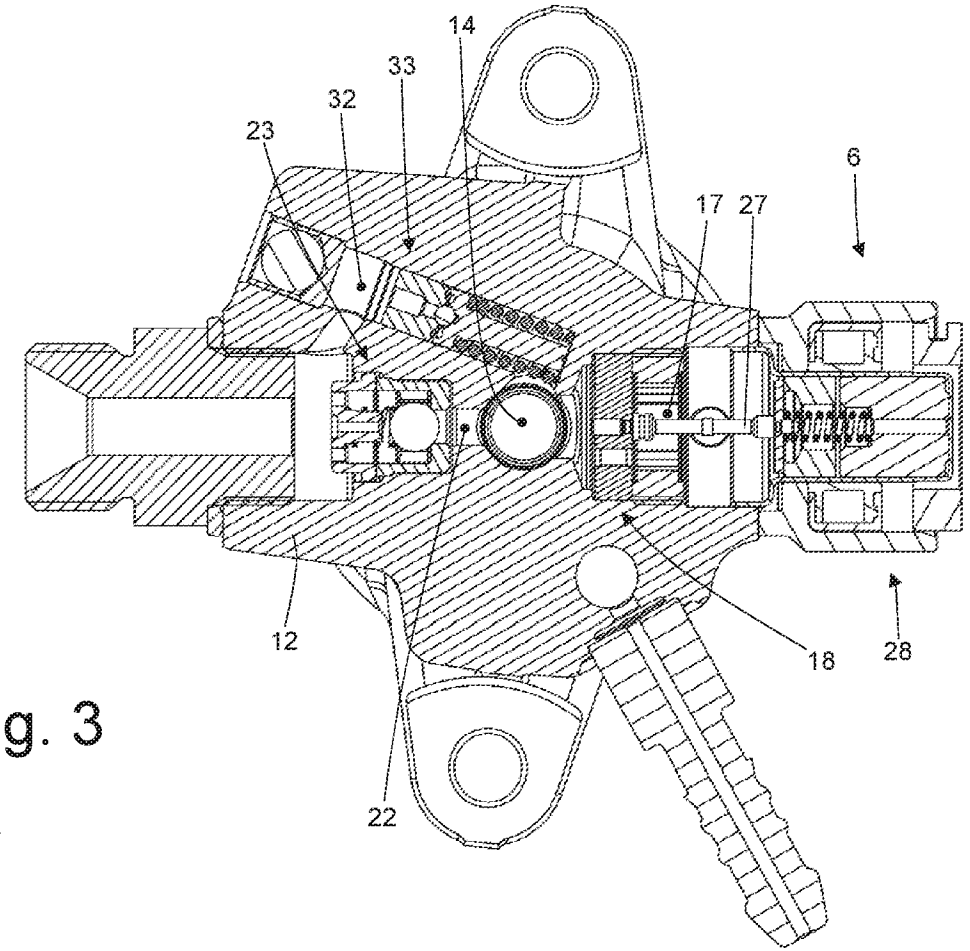
FIG. 3 is a cross section view, lacking some components for clarity's sake, of the high-pressure fuel pump of FIG. 2.

As shown in FIGS. 2 and 3, the high-pressure pump 4 comprises a main body 12 that has a longitudinal axis 13 and defines inside it a cylindrical pumping chamber 14. Inside the pumping chamber 14 it is mounted a piston 15 that, sliding with reciprocating motion along the longitudinal axis 13, determines a cyclic variation of the volume of the pumping chamber 14. A lower portion of the piston 15 is, on the one side, coupled to an implementation spring 16 which tends to push the piston 15 towards a maximum volume position of the pumping chamber 14 and, on the other side, coupled to a cam (not shown) which is brought into rotation by a drive shaft of the engine for cyclically moving the piston 15 upwards by compressing the implementation spring 16.

A side wall of the pumping chamber 14 originates an intake channel 17 that is connected to the low-pressure pump 8 through the supply duct 10 and is regulated by an intake valve 18 arranged at the pumping chamber 14. The intake valve 18 comprises a disc having a series of through holes, through which the fuel can flow, and a deformable circular lamina that rests on a base of the disc closing the passage through the intake holes. The pressure of the intake valve 18 is usually controlled and in the absence of any external intervention, the intake valve 18 is closed when the fuel pressure in the pumping chamber 14 is higher than the fuel pressure in the intake channel 17 and is open when the fuel pressure in the pumping chamber 14 is lower than the fuel pressure in the intake channel 17. In particular, when the fuel flows towards the pumping chamber 14, the lamina deforms by moving away from the disc under the thrust of the fuel, thus allowing the passage of the fuel through the intake holes, while when the fuel flows from the pumping chamber 14, the lamina is pressed against the disc, thus sealing the intake holes and preventing the passage of the fuel through the intake holes.

A side wall of the pumping chamber 14 and the opposite side with respect to the intake channel 17 originate a delivery channel 22 that is connected to the common rail 3 through the supply duct 5 and is regulated by a one-way delivery valve 23 that is arranged at the pumping chamber 14 and allows only a fuel flow to leave the pumping chamber 14.

The delivery valve 23 comprises a spherical shutter movable along the delivery channel 22 and a valve seat, which is designed to be engaged in fluid-tight manner by the shutter and is arranged at the end of the delivery channel 22 communicating with the pumping chamber 14; a calibrated spring pushes the shutter towards a fluid-tight engagement position with the valve seat. The pressure of the delivery valve 23 is controlled, since the forces arising from the pressure differences across the delivery valve 23 are much greater than the force generated by the spring; in particular, the delivery valve 23 is open when the fuel pressure in the pumping chamber 14 is higher than the fuel pressure in the delivery channel 22 and is closed when the fuel pressure in the pumping chamber 14 is lower than the fuel pressure in the delivery channel 22.

The regulating device 6 is coupled to the intake valve 18 so that the control unit 7 keeps the intake valve 18 open during a pumping phase of the piston 15 and therefore allows a fuel flow to leave the pumping chamber 14 through the intake channel 17. The regulating device 6 comprises a control rod 27, which is coupled to the lamina 21 of the intake valve 18 by means of a central through hole formed through the disc and is movable between a passive position, where it allows the lamina to engage in fluid-tight manner the disk for sealing the intake holes, and an active position, where it does not allow the lamina to engage in fluid-tight manner the disk, thus leaving open the intake holes. The regulating device 6 further comprises an electromagnetic actuator 28, which is coupled to the control rod 27 to move the control rod between the active position and the passive position. The electromagnetic actuator 28 comprises a spring which keeps the control rod 27 in the active position and an electromagnet driven by the control unit 7 and designed to move the control rod 27 in the passive position by magnetically attracting a ferromagnetic armature integral with the control rod 27; in particular, when the electromagnet is energized, the control rod 27 comes back to the aforementioned passive position and the communication between the intake channel 17 and the pumping chamber 14 can be stopped by closing the intake valve 18.

An upper wall of the pumping chamber 14 originates a drain channel 32, which connects the pumping chamber 14 to the delivery channel 22 and is regulated by a one-way maximum-pressure valve 33 that only allows a fuel flow to enter the pumping chamber 14. The maximum-pressure valve 33 allows a fuel venting if the fuel pressure in the common rail 3 exceeds a maximum value set in the design phase (e.g. in case of errors in the check carried out by the control unit or in the event of a failure of an injector). In other words, the maximum-pressure valve is calibrated to open automatically when the pressure difference across its ends is higher than a threshold value set in the design phase and therefore to prevent the fuel pressure in the common rail 3 from exceeding the maximum value set in the design phase.

In use, when the piston 15 is in the intake phase and the fuel pressure in the common rail 3 exceeds the maximum value set in the design phase, the maximum-pressure valve 33 opens before the intake valve 18 (thus preventing the intake valve 18 from opening), thus filling the pumping chamber 14 with fuel coming only from the delivery channel 22 and therefore avoiding a further increase in the fuel pressure in the common rail 3.

Figure 4:
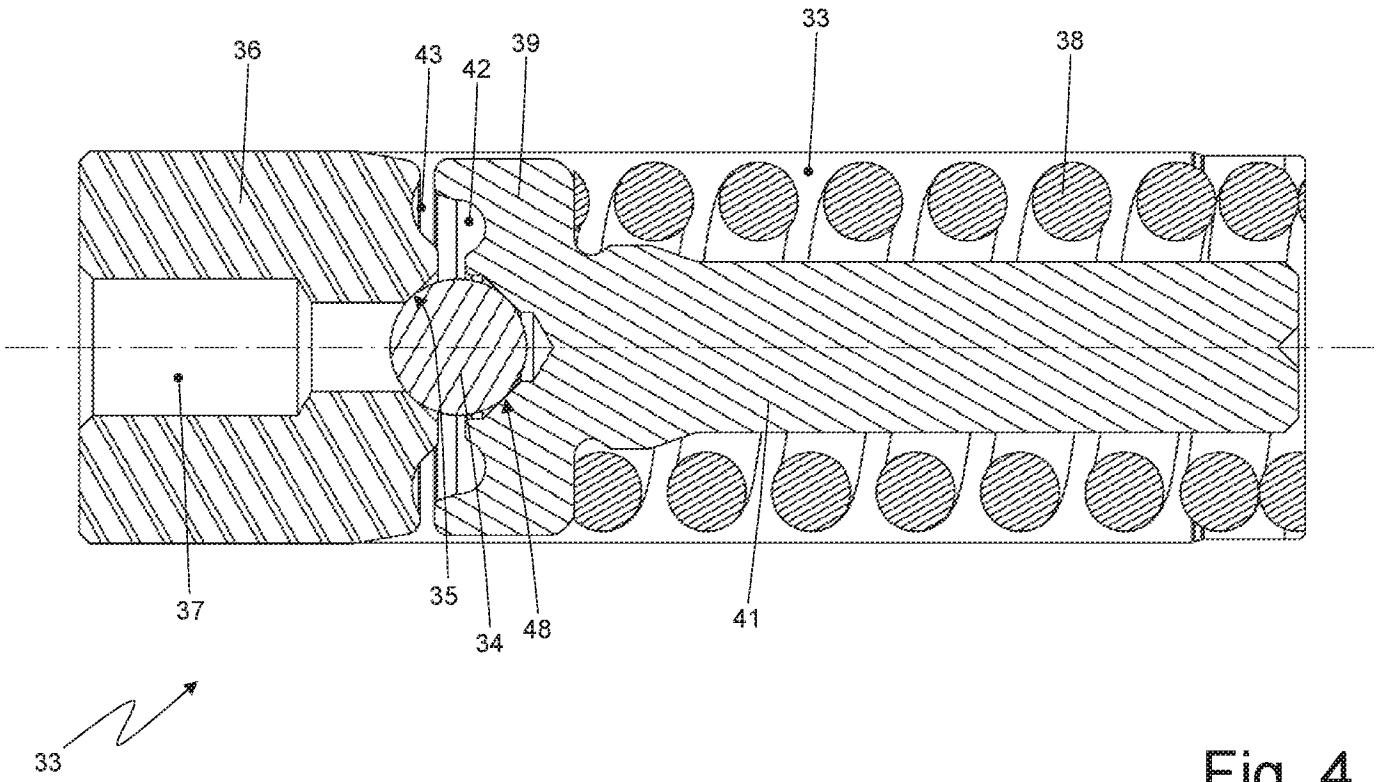
FIG. 4 is an enlarged view of a maximum-pressure valve of the high-pressure fuel pump of FIG. 2.
Figure 5:
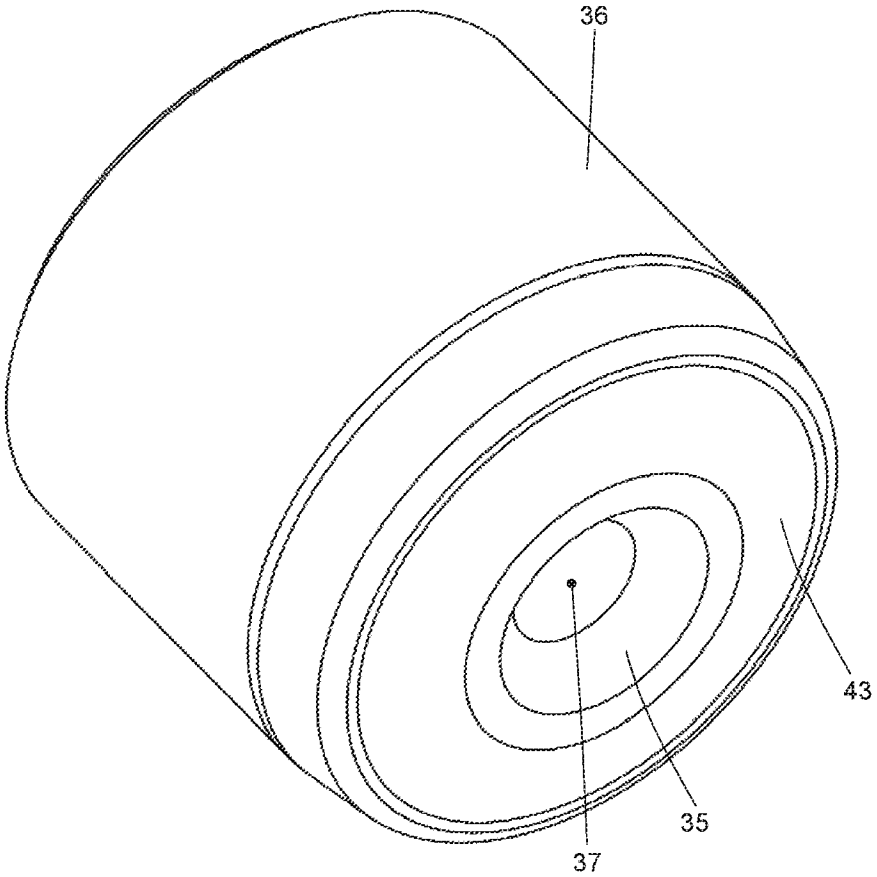
FIG. 5 is a perspective view of a valve body of the maximum-pressure valve of FIG. 4.
Figure 6:
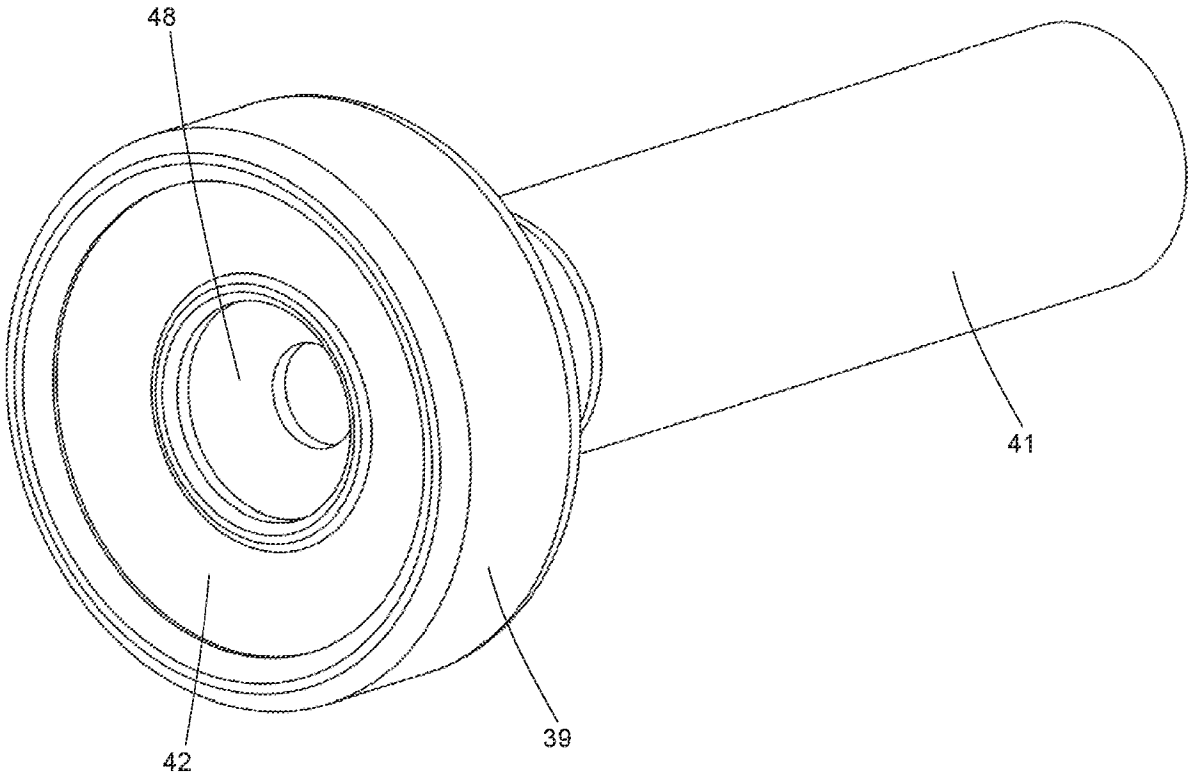
FIG. 6 is a perspective view of a calibrated plate of the maximum-pressure valve of FIG. 4.

As shown in FIG. 4, the maximum-pressure valve 33 comprises a spherical shutter 34 movable along the drain channel 32 and a valve seat 35, which is formed in a centrally drilled valve body 36 and is designed to be engaged in fluid-tight manner by the shutter 34. In particular, the valve body 36 has a central through channel 37 whose inlet mouth is arranged in the middle of the valve seat 35 and then is sealed by the shutter 34 when the shutter 34 is pushed against the valve seat 35. A calibrated spring 38 pushes the shutter 34 towards a fluid-tight engagement position with the valve seat 35. The elastic force of the spring 38 is calibrated so that the shutter 34 separates from the valve seat 35 when and only when the fuel pressure in the common rail 3 exceeds the maximum value set in the design phase.

Moreover, the maximum-pressure valve 33 comprises a calibrated plate 39 that locally determines a reduction of the fuel passage section 40 through the drain channel 32 (better shown in FIG. 7); the size (i.e. the diameter) of the calibrated plate 39 is determined so as to obtain at the calibrated plate 39 an annular fuel passage section 40 having a limited area corresponding to a desired value. According to the embodiment shown in FIG. 4, the calibrated plate 39 is interposed between an end of the spring 38 and an end of the shutter 34 and rests both on the shutter 34 and on the spring 38. In particular, the calibrated plate 39 is provided with a rod 41 that is integral with the calibrated plate 39, is inserted inside the spring 38 and whose function is both preventing any undesired rotation of the plate 39 and forming an end-of-travel element with a maximum opening for the shutter 34 (i.e. when the end of the rod 41 opposite the plate 39 rests on the bottom wall of the drain channel 32, the opening stroke of the shutter 34 is stopped). According to a different embodiment not shown, the calibrated plate 39 is integral (e.g. welded) with the shutter 34, or is integral (e.g. welded) with the spring 38. According to a preferred embodiment, the calibrated plate 39 is integral with the shutter 34 so as to avoid that the shutter 34 can vibrate when the maximum-pressure valve 33 opens; in fact, possible vibrations of the shutter 34 could cause in the long period breakings (cracks) for fatigue of the plate 39 or of the valve body 36.

As described in the patent application EP2236809A2 to which reference is made, when the maximum-pressure valve 33 opens due to the excessive fuel pressure in the common rail 3, thanks to the calibrated plate 39, the overall thrust acting on the shutter 34 can be approximately constant when varying the opening of the maximum-pressure valve 33. In this way, the maximum fuel pressure in the common rail 3 remains approximately constant when varying the speed of the engine, i.e. when varying the instantaneous flow rate of the high-pressure pump 4.

Figure 7:
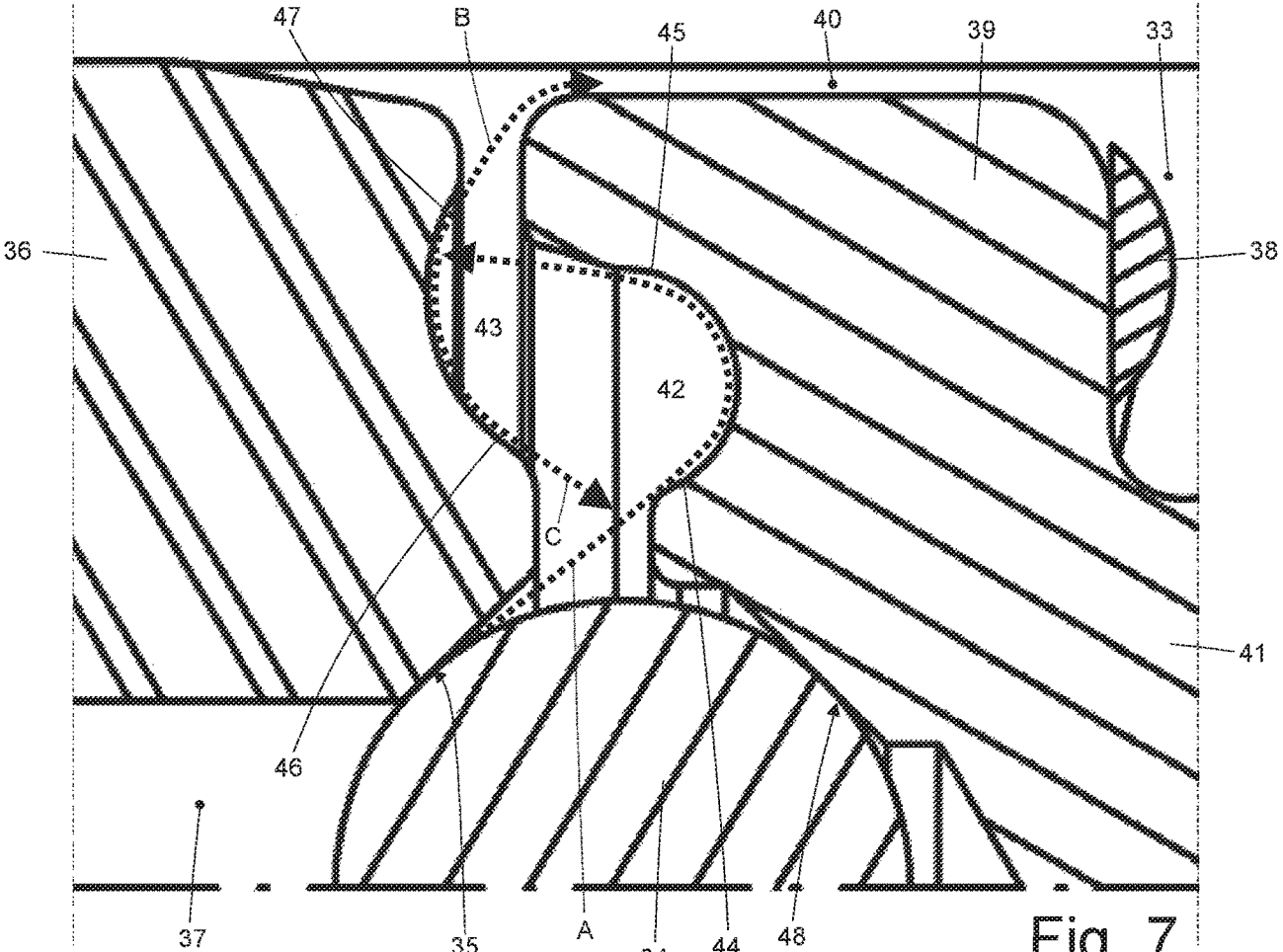
FIG. 7 is a view of the maximum-pressure valve of FIG. 4 showing the fuel flows passing through the maximum-pressure valve.

As shown more clearly in FIG. 7, the plate 39 of the maximum-pressure valve 33 has an annular groove 42, which is arranged around the shutter 34 and has a bowl-shaped (namely "U"-shaped) longitudinal section and a curved profile without discontinuities (i.e. the profile gradually varies without discontinuities). Analogously, the valve body 36 of the maximum-pressure valve 33 has an annular groove 43, which is arranged around the shutter 34 (i.e. around the valve seat 35), at least partially faces the annular groove 42 of the plate 39, and has a bowl-shaped (namely "U"-shaped) longitudinal section and a curved profile without discontinuities (i.e. the profile gradually varies without discontinuities).

According to a preferred but non-limiting embodiment shown in the attached figures, in longitudinal section the curved profile of the annular groove 42 has an inner surface 44 which is arranged closer to the shutter 34 and has an end inclination directed towards the valve seat 35; in other words, the inner surface 44 of the annular groove 42 is oriented so that an extension of the inner surface 44 "hits" or "laps" the valve seat 35. According to a preferred but non-limiting embodiment shown in the attached figures, in longitudinal section the curved profile of the annular groove 42 has an outer surface 45 that is arranged farther from the shutter 34 and has an end inclination directed towards the annular groove 43. In other words, the outer surface 45 of the annular groove 42 is oriented so that an extension of the outer surface 45 "hits" the annular groove 43.

According to a preferred but non-limiting embodiment shown in the attached figures, in longitudinal section the curved profile of the annular groove 43 has an inner surface 46 which is arranged closer to the shutter 34 and has an end inclination directed towards an area of the plate 39 between the shutter 34 and the annular groove 42. In other words, the inner surface 46 of the annular groove 43 is oriented so that an extension of the inner surface 46 "hits" an area of the plate 39 between the shutter 34 and the annular groove 42. Alternatively, the inner surface 46 of the annular groove 43 could have an end inclination directed towards the annular groove 42 (close to the limit of the inner surface 44). In other words, the inner surface 46 of the annular groove 43 is oriented so that an extension of the inner surface 46 "hits" the annular groove 42 (close to the limit of the inner surface 44). According to a preferred but non-limiting embodiment shown in the attached figures, in longitudinal section the curved profile of the annular groove 43 has an outer surface 47 that is farther from the shutter 34 and has an end inclination directed towards an annular meatus comprised between the plate 39 and an inner wall of the drain channel 32. In other words, the outer surface 47 of the annular groove 43 is oriented so that an extension of the outer surface 47 "hits" the annular meatus comprised between the plate 39 and the inner wall of the drain channel 32.

According to a preferred but non-limiting embodiment shown in the attached figures, an inner edge of the annular groove 43 arranged closer to the shutter 34 is arranged at an axial height that is different from the one of an outer edge of the annular groove 43 arranged farther from the shutter 34 so that the inner edge of the annular groove 43 is axially closer to the spring 38 than the outer edge of the annular groove 43.

According to a preferred but non-limiting embodiment shown in the attached figures, an inner edge of the annular groove 42 arranged closer to the shutter 34 is arranged at an axial height that is different from the one of an outer edge of the annular groove 42 arranged farther to the shutter 34 so that the inner edge of the annular groove 42 is axially closer to the spring 38 than the outer edge of the annular groove 42.

According to a preferred embodiment shown in the accompanying figures, the plate 39 is centrally provided with a seat 48, which is designed to house the shutter 34 and is surrounded by the annular groove 42.

With reference to FIG. 7, a description of the operation of the maximum-pressure valve 33 is given hereinafter.

When the thrust generated by the hydraulic pressure on the ends of the maximum-pressure valve 33 is lower than the elastic force generated by the spring 38 (i.e. when the pressure difference across the maximum-pressure valve 33 is lower than the threshold value set in the design phase), the maximum-pressure valve 33 remains closed and the shutter 34 remains pressed against the valve seat 35, thus sealing the valve seat 35. When the thrust generated by the hydraulic pressure on the ends of the maximum-pressure valve 33 is higher than the elastic force generated by the spring 38 (i.e. when the pressure difference across the maximum-pressure valve 33 is higher than the threshold value set in the design phase), the maximum-pressure valve 33 opens and the shutter 34 shifts away from the valve seat 35 compressing the spring 38. When the shutter 34 shifts away from the valve seat 35, a fuel flow A (i.e. a fluid vein) passes through the free space between the shutter 34 and the valve seat 35, is inserted in the annular groove 42 and is deviated by the annular groove 42 following the curved profile of the annular groove 42. Consequently, the fuel flow A leaves the annular groove 42 and enters the annular groove 43 against which it "bangs", thus dividing into a fuel flow B (i.e. a fluid vein) that continues (along the outer surface 47 of the annular groove 43) towards the annular meatus comprised between the plate 39 and the inner wall of the drain channel 32 (i.e. it continues along the drain channel 32, flowing out of the drain channel in the end) and into a fuel flow C (i.e. a fluid vein) that comes back to the annular groove 42 (along the inner surface 46 of the annular groove 43). Leaving the annular groove 42, the fuel flow C re-joins the fuel flow A and pushes the fuel flow A against the plate 39, i.e. lets the fuel flow A adhere to the plate 39; in this way, the fuel flow A flows along the whole annular groove 42, i.e. strongly invests the whole surface of the annular groove 42 since it is pushed against the annular groove 42 by the fuel flow C (in other words, the fuel flow C increases the area of the annular groove 42 which is "wet" by the fuel flow A as it pushes the fuel flow A against the annular groove 42).

Flowing along the annular groove 42, the fuel flow A generates a hydraulic dynamic thrust that contributes to compress the spring 38 faster, i.e. contributes to open the maximum-pressure valve 33 faster; in this way, the opening of the maximum-pressure valve 33 is ready and fast even when the fuel pressure in the common rail 3 slightly exceeds the maximum value set in the design phase, thus avoiding that a "lazy" opening of the maximum-pressure valve 33 will increase the fuel pressure in the common rail 3 well beyond the maximum value set in the design phase. The fuel flow C generated by the annular groove 43 pushes the fuel flow A against the annular groove 42, thus significantly increasing the hydraulic dynamic thrust generated by the fuel flow A along the annular groove 42 (i.e. the presence of the fuel flow C coming from the annular groove 43 increases the efficiency of the thrust generated by the annular groove 42); then, the presence of the annular groove 43 allows to increase the efficiency and effectiveness of the annular groove 42. The inner surface 44 of the annular groove 42 has an end inclination directed towards the valve seat 35 to best house the fuel flow coming from the free space between the shutter 34 and the valve seat 35. The outer surface 45 of the annular groove 42 has an end inclination directed towards the annular groove 43 to direct the fuel flow towards the annular groove 43. The inner surface 46 of the annular groove 43 has an end inclination directed towards an area of the plate 39 comprised between the shutter 34 and the annular groove 42 to direct the fuel flow B towards the annular meatus comprised between the plate 39 and the inner wall of the drain channel 32. The inner surface 46 of the annular groove 43 has an end inclination directed towards an area of the plate 39 comprised between the shutter 34 and the annular groove 42 to direct the fuel flow C towards the fuel flow A entering the annular groove 42. The outer surface 47 of the annular groove 43 has an end inclination directed towards the annular meatus comprised between the plate 39 and the inner wall of the drain channel 32 to direct the fuel flow B towards the annular meatus comprised between the plate 39 and the inner wall of the drain channel 32.

As shown in FIG. 2, the intake channel 17 connects the supply duct 10 to the pumping chamber 14, is regulated by the intake valve 18 (arranged at the pumping chamber 14) and extends partially inside the main body 12. According to a preferred embodiment, a compensating chamber 49 is arranged along the intake channel 17 (upstream of the intake valve 18), said chamber housing elastically deformable (or better, elastically compressible) compensating bodies 50.

In the embodiment shown in the attached figures, the drain channel 32 connects the delivery channel 22 to the pumping chamber 14. According to a different and perfectly equivalent embodiment not shown, the drain channel 32 connects the delivery channel 22 to the intake channel 17; in this case, the drain channel 32 preferably leads into the compensating chamber 49, i.e. the compensating chamber 49 houses an outlet end of the drain channel 32.

The aforesaid high-pressure pump 4 has numerous advantages.

First, the opening of the maximum-pressure valve 33 is ready and fast even when the fuel pressure in the common rail 3 slightly exceeds the maximum value set in the design phase, thus avoiding that a "lazy" opening of the maximum-pressure valve 33 will increase the fuel pressure in the common rail 3 well beyond the maximum value set in the design phase.

Then, the maximum-pressure valve 33 is easy and inexpensive to manufacture since, if compared to a similar known maximum-pressure valve, it differs only for the presence of the annular grooves 42 and 43 that are extremely easy to manufacture by means of a trivial mechanical machining.

The invention claimed is:

1. A fuel pump (1) for a direct-injection system; the fuel pump (1) comprises:

at least one pumping chamber (14);

a piston (15), which is mounted so as to slide inside the pumping chamber (14) to cyclically change the volume of the pumping chamber (14);

an intake channel (17), which is connected to the pumping chamber (14) and is regulated by an intake valve (18);

a delivery channel (22), which is connected to the pumping chamber (14) and is regulated by a one-way delivery valve (23), which only permits a fuel flow flowing out of the pumping chamber (14); and a drain channel (32), which originates in the delivery channel (22) and is regulated by a one-way, maximum-pressure valve (33), which opens when the fuel pressure in the delivery channel (22) exceeds a threshold value;

wherein the maximum-pressure valve (33) comprises: a shutter (34), which is movable along the drain channel (32), a valve body (36), which is provided with a valve seat (35) designed to be engaged in fluid-tight manner by the shutter (34), a spring (38), which is calibrated to push the shutter (34) towards an engaging position where it engages the valve seat (35) in a fluid-tight manner; and a plate (39), which is arranged in contact with the shutter (34) on the opposite side of the valve seat (35);

wherein the plate (39) of the maximum-pressure valve (33) has a first annular groove (42), which is arranged around the shutter (34); and wherein the valve body (36) of the maximum-pressure valve (33) has a second annular groove (43), which is arranged around the shutter (34) and at least partially faces the first annular groove (42) of the plate (39).

2. A fuel pump (1) according to claim 1, wherein the second annular groove (43) is, in its longitudinal section, bowl-shaped and has a curved profile without discontinuities.

3. A fuel pump (1) according to claim 2, wherein, in its longitudinal section, the curved profile of the second annular groove (43) has an inner surface (46), which is arranged closer to the shutter (34) and has an end inclination directed towards an area of the plate (39) that is comprised between the shutter (34) and the first annular groove (42).

4. A fuel pump (1) according to claim 2, wherein, in its longitudinal section, the curved profile of the second annular groove (43) has an outer surface (47), which is arranged farther from the shutter (34) and has an end inclination directed towards an annular meatus comprised between the plate (39) and an inner wall of the drain channel (32).

5. A fuel pump (1) according to claim 1, wherein the first annular groove (42) is, in its longitudinal section, bowl-shaped and has a curved profile without discontinuities.

6. A fuel pump (1) according to claim 5, wherein, in its longitudinal section, the curved profile of the first annular groove (42) has an inner surface (44), which is arranged closer to the shutter (34) and has an end inclination directed towards the valve seat (35).

7. A fuel pump (1) according to claim 5, wherein, in its longitudinal section, the curved profile of the first annular groove (42) has an outer surface (45), which is arranged father from the shutter (34) and has an end inclination directed towards the second annular groove (43).

8. A fuel pump (1) according to claim 1, wherein an inner edge of the second annular groove (43) arranged closer to the shutter (34) is arranged at an axial height that is different from the one of an outer edge of the second annular groove (43) arranged farther from the shutter (34), so that the inner edge of the second annular groove (43) is axially closer to the spring (38) than the outer edge of the second annular groove (43).

9. A fuel pump (1) according to claim 1, wherein an inner edge of the first annular groove (42) arranged closer to the shutter (34) is arranged at an axial height that is different from the one of an outer edge of the first annular groove (42) arranged farther from the shutter (34), so that the inner edge of the first annular groove (42) is axially closer to the spring (38) than the outer edge of the first annular groove (42).

10. A fuel pump (1) according to claim 1, wherein the plate (39) has a central seat (48), which is designed to house the shutter (34) and is surrounded by the first annular groove (42).

11. A fuel pump (1) according to claim 1, wherein the calibrated plate (39) is interposed between an end of the spring (38) and an end of the shutter (34).

12. A fuel pump (1) according to claim 11, wherein the calibrated plate (39) is provided with a rod (41), which is inserted inside the spring (38).

13. A fuel pump (1) according to claim 1, wherein the drain channel (32) connects the delivery channel (22) to the pumping chamber (14).

14. A fuel pump (1) according to claim 1, wherein the drain channel (32) connects the delivery channel (22) to the intake channel (17).

15. A fuel pump (1) according to claim 14 and comprising a compensating chamber (49), which is arranged along the intake channel (17), houses at least one elastically deformable compensating body (50) to attenuate the pulsations of the fuel flow, and receives an outlet end of the drain channel (32).

* * * * *